US008311224B2

(12) United States Patent
Chen et al.

(10) Patent No.: US 8,311,224 B2
(45) Date of Patent: Nov. 13, 2012

(54) METHOD AND SYSTEM UTILIZING QUANTUM AUTHENTICATION

(76) Inventors: Zhihong Chen, Nepean (CA); Jingyi Wang, Dublin, CA (US)

( * ) Notice: Subject to any disclaimer, the term of this patent is extended or adjusted under 35 U.S.C. 154(b) by 945 days.

(21) Appl. No.: 12/253,256

(22) Filed: Oct. 17, 2008

(65) Prior Publication Data

US 2009/0106553 A1 Apr. 23, 2009

Related U.S. Application Data

(60) Provisional application No. 61/000,046, filed on Oct. 24, 2007.

(51) Int. Cl.
*H04L 29/06* (2006.01)

(52) U.S. Cl. ..... 380/278; 380/46; 380/256

(58) Field of Classification Search ..... 380/46, 380/256, 278

See application file for complete search history.

(56) References Cited

U.S. PATENT DOCUMENTS

| | | | | |
|---|---|---|---|---|
| 5,307,410 | A | 4/1994 | Bennett | |
| 2003/0169880 | A1 | 9/2003 | Nambu | |
| 2004/0151321 | A1 * | 8/2004 | Lutkenhaus | 380/278 |
| 2004/0156502 | A1 * | 8/2004 | Weinfurther et al. | 380/44 |
| 2006/0280509 | A1 * | 12/2006 | Tomaru et al. | 398/188 |
| 2007/0071244 | A1 | 3/2007 | LaGasse | |
| 2008/0137858 | A1 | 6/2008 | Gelford | |
| 2010/0027794 | A1 * | 2/2010 | Yuan et al. | 380/255 |

OTHER PUBLICATIONS

Alleaume, Romain, "SECOQC White Paper on Quantum Key Distribution and Cryptography", Jan. 22, 2007.

Bennett, C.H., "Quantum Cryptography: Public Key Distribution and Coin Tossing", Proceedings of the International Conference on Computers, Systems and Signal Processing, Bangalore, India, IEEE, New York, 1984, pp. 175-179, Dec. 10-12, 1984.

Trifonov, A. et al.; Practical Quantum Cryptography; Quantum Information and Computation II (Proceedings Volume); Aug. 24, 2004; vol. 5436.

* cited by examiner

*Primary Examiner* — Justin T Darrow

(74) *Attorney, Agent, or Firm* — Dinsmore & Shohl LLP

(57) ABSTRACT

A system and a method with quantum cryptography authentication. The system includes an optical link connecting a sender and a receiver. The sender transmitting a first optical pulse and a second optical pulse having a defined time delay therebetween. The first pulse is modulated with a first authentication phase shift; and the second pulse is modulated with phases selected from one basis of two non-orthogonal bases, and encoded with one of two orthogonal states within the one basis based on an information of the sender, and with a second authentication phase shift. The receiver includes a splitter receiving and splitting the first and the second pulse into pulses of interest. The split pulses of interest are modulated with the first authentication phase shift; and the second authentication phase shift, respectively. The receiver includes a second coupler whereby the split pulses of interest arrive at the second coupler simultaneously. The receiver includes a first set of detectors receiving the combined pulses, which determine the one basis of the two non-orthogonal bases; and a second set of detectors receiving the combined pulses, and determine the one of the two orthogonal states within the basis and thereby decoding the information of the sender.

20 Claims, 6 Drawing Sheets

(a)

| Basis | 0 | 1 |
|---|---|---|
| + | ↑ | → |
| × | ↗ | ↘ |

(b)

| | 232 | 234 | 236 | 238 | 240 | 242 | 244 | 246 | |
|---|---|---|---|---|---|---|---|---|---|
| Alice's random bit | 0 | 1 | 1 | 0 | 1 | 0 | 0 | 1 | 220 |
| Alice's random sending basis | + | + | × | + | × | × | × | + | 222 |
| Photon polarization Alice sends | ↑ | → | ↘ | ↑ | ↘ | ↗ | ↗ | → | 224 |
| Bob's random measuring basis | + | × | × | × | + | × | + | + | 226 |
| Photon polarization Bob measures | ↑ | ↗ | ↘ | ↗ | → | ↗ | → | → | 228 |
| Shared secret key | 0 | | 1 | | | 0 | | 1 | 230 |

METHOD AND SYSTEM UTILIZING QUANTUM AUTHENTICATION

CROSS-REFERENCE TO RELATED APPLICATIONS

This application is related to and claims priority from U.S. Provisional Application Ser. No. 61/000,046, filed on Oct. 24, 2007, entitled "Quantum Information System with Quantum Auth" by Jingyi Wang, the entire disclosure of which is hereby incorporated by reference for all purposes as if fully set forth herein.

BACKGROUND OF THE INVENTION

The present invention relates generally to information security, and more specifically, to method and system utilizing quantum authentication.

Cryptography is concerned with the secure transmission of information between two parties. Unconditional secure key distribution and unconditional secure authentication are well recognized as the two fundamentals that the strength of any cryptographic system depends on.

Referring to FIG. 1, when a classical communication channel 102 is established between a sender ("Alice") and a receiver ("Bob"), respectively, as widely used in the art, there is always a possibility that a third party ("Eve") may eavesdrop on the channel 102. In classical cryptography Alice typically uses a cryptographic key 104 to encrypt the text prior to transmission over the channel 102 to Bob, so that the information encrypted with the key 106 remains secure even if the channel is public. In order for Bob to decrypt the message, however, the key 104 must be communicated. Thus, to securely share private information, Alice and Bob must already have shared private information, namely the cryptographic key 104. A basic problem of cryptography, therefore, is how to initially establish a private key between Alice and Bob, and how to ensure that such a key distribution technique is secure against Eve. If Alice and Bob communicate solely through classical messages, it is impossible for them to generate a certifiably cryptographic key due to the possible passive eavesdropping.

It has been proven that Vernam cipher, i.e., one-time-pad, is the only unconditional secure encryption algorithm. However, this encryption requires that the cryptographic key must truly be random, at least equal to the message length, and strictly used only once. The reason why it can only be used one-time is that the repeated use of the same key is prone to so-called 'paper-and-pencil' attack or running key attack. In short, the symmetric encryption uses a binary XOR operation to encrypt and decrypt messages. The XOR operation will automatically be eliminated once the key is reused:

Clear text A and B are encrypted by a key C

E(A)=A XOR C, E(B)=B XOR C;

E(A) XOR E(B)=(A XOR C) XOR (B XOR C)=A XOR B.

Therefore, the key C is eliminated from the operation. Although A and B may be time-consuming to find out using computers, they may be easily figured out manually by using paper and pencil.

While the Vernam cipher does provide provable information-theoretic security on public channels, it is not widely used mainly due to difficulty in distributing one-time-pad, and that every bit of information to be ciphered requires one bit in the one-time-pad.

Quantum key distribution (QKD) provides an alternative for unconditional key distribution. Using techniques that take advantage of the inviolability of the laws of quantum mechanics and provably secure public discussion protocols. Eve can neither "tap" the key transmissions owing to the indivisibility of quanta nor copy them faithfully because of the quantum "no-cloning" theorem. QKD resists interception and retransmission by an eavesdropper because the result of a measurement cannot be thought of as revealing a "possessed value" of a quantum state. A unique aspect of quantum cryptography is that the Heisenberg uncertainty principle ensures that if Eve attempts to intercept and measure Alice's quantum transmissions, her activities must produce an irreversible change in the quantum states that are retransmitted to Bob. These changes will introduce an error rate having a high number of anomalies in the transmissions between Alice and Bob, allowing them to detect the attempted eavesdropping. In particular, from the observed error rate Alice and Bob can put an upper bound on any partial knowledge that an eavesdropper may have acquired by monitoring their transmissions. This bound allows the intended users to apply conventional information theoretic techniques by public discussion to distill an error-free, secret key.

The general principles of quantum cryptography were first set forth by Bennett and Brassard in their article "Quantum Cryptography: Public key distribution and coin tossing," Proceedings of the International Conference on Computers, Systems and Signal Processing, Bangalore, India, 1984, pp. 175-179 (IEEE, New York, 1984). This quantum key distribution (QKD) is generally known as "BB84 protocol". Exemplary QKD systems are also described in U.S. Pat. No. 5,307,410 to Bennett, and in the article by C. H. Bennett entitled "Quantum Cryptography Using Any Two Non-Orthogonal States", Physical Review Letters 68(21) 3121-3124 (1992), all three documents are incorporated herein by reference.

FIG. 2 illustrates a four-state scheme as described in BB84 protocol for quantum key distribution in which the polarization of a single photon is used for encoding cryptographic values.

Referring to FIG. 2(*a*), two pairs of states 202, 204 are used for encoding cryptographic values, with each pair non-orthogonal to the other pair. The two states within a pair are orthogonal to each other. Pairs of orthogonal states are referred to as a basis. In the example shown, two non-orthogonal polarization bases (rectilinear basis and diagonal basis) are used to encode the "0" and "1". The state pairs used in the rectilinear basis 202 are vertical (0°, ↑) 206 and horizontal (90°, →) 208, the diagonal basis 204 includes a 45° (↗) state 210 and a 135° (↘) state 212. Bits "0" 214 and "1" 216 are encoded as Eigen state (↑, →) in rectilinear basis 202 and Eigen state (↗, ↘) in diagonal basis 204, respectively. Other orthogonal states include circular basis of left- and right-handedness, or phase shift scheme. In a phase shift scheme, bits "0" and "1" can be encoded as (0, π) in basis 1 and (π/2, 3π/2) in basis 2, respectively.

The BB84 protocol is based on the uncertainty principle that in a single quantum system two sets of mutually non-orthogonal bases cannot be measured with certainty at the same time. A given orthogonal basis (e.g., the diagonal basis) can always be represented by a superposition of another basis non-orthogonal to it (e.g., the rectilinear basis). A measurement that can reliably distinguish a given basis would inevitably destroy the superposition state of the given basis (that is, non-orthogonal basis) and cause the given basis to collapse. More generally, a measurement that can partially distinguish a given basis would partially destroy the superposition state of the given basis and the state after measurement approaches statistical mixture of the given basis. Referring to FIG. 2(*b*), to begin the quantum key distribution process, Alice generates random bit values 220 and random bases (rectilinear basis or diagonal basis) 222 and then prepares a photon polarization state 224 (e.g. (↑, →, ↗, ↘)) depending both on the random bit value and random basis. So for example a "0" is encoded in the rectilinear basis (+) as a vertical polarization state (↑), and a "1" is encoded in the diagonal basis (x) as a 135° (↘) state. Alice transmits a single photon in the state specified to Bob, but does not tell anyone the polarization of the photons she has transmitted. Bob receives the photons and measures their polarization along either in a rectilinear or diagonal basis with randomly selected and substantially equal probability 226. Bob records his chosen basis and his measurement results 228. Thus, the state of the photons which are in the Eigen state of diagonal basis cannot be distinguished when rectilinear basis are used at Bob 240 244, and the state of the photons which are in the Eigen state of rectilinear basis cannot be distinguished when diagonal basis are used at Bob 234, 238. These measurements will produce an error with a probability of 50%.

After Bob has measured all the photons, he communicates with Alice over the public classical channel. Alice broadcasts the basis each photon was sent in, and Bob, the basis each was measured in. They both discard photon measurements (bits) 234, 238, 240 and 244 where Bob used a different basis, which will be half on average, leaving half the bits 232, 236, 242 and 246 as a shared key 230.

Alice and Bob then estimate whether Eve has eavesdropped upon the key distribution. To do this, Alice and Bob must agree upon a maximum tolerable error rate. Errors can occur due to the intrinsic noise of the quantum channel and due to eavesdropping attack by a third party. Alice and Bob choose randomly a subset of photons m from the sequence of photons that have been transmitted and measured on the same basis. For each of the m photons, Bob announces publicly his measurement result. Alice informs Bob whether his result is the same as what she had originally sent. They both then compute the error rate of the m photons and, since the measurement results of the m photons have been discussed publicly, the polarization data of the m photons are discarded. If the computed error rate is higher than the agreed upon tolerable error rate, Alice and Bob infer that substantial eavesdropping has occurred. If the error rate is acceptably small, Alice and Bob adopt the remaining polarizations, or some algebraic combination of their values, as secret bits of a shared secret key, interpreting horizontal (↑) or 45° (↗) polarized photons as binary 0's and vertical (→) or 135° (↘) photons as binary 1's.

This protocol is secure for key distribution based on two assumptions:

1. unconditional secure authentication is achieved before key distribution starts;
2. only single photon pulses are allowed.

To prevent an impersonation attack, the public channel messages must be authenticated or otherwise protected against alternation or substitution. Authentication is the process that ensures that the parties communicating with each other over a communication link are who they say they are. In a QKD system, Alice and Bob must be sure they are talking to each other and that there is no man-in-the-middle impersonating Bob or Alice. This problem is addressed by authentication, which is classical and depends on the security of the key on which authentication is based. Unconditionally secure authentication protocols exist, so that if the key used is unconditionally secure the authentication can be made unconditionally secure as well. If the security is compromised, Alice and Bob must recheck that they are indeed communicating with each other and not to an eavesdropper in between. They can repeatedly perform authentication if they share keys they can absolutely trust.

The authentication protocol is also the only guarantee that Eve cannot change the data in a classical communication between Alice and Bob.

The authentication procedure works as follows. The initial key for authentication is preinstalled by a trusted party. The QKD system is capable of producing keys, or key regeneration, and delivering enough fresh keys for authentication purposes. The security of the new key depends on the security of the QKD protocol.

However, existing authentication mechanisms may be based on mathematical difficulties, which are not unconditionally secure. If the traditional QKD cryptography is equal to classical conditional security for authentication plus quantum unconditional security for key distribution, the overall security level (authentication plus key distribution) is conditionally secure.

Meanwhile, without guaranteed single photon pulses, QKD voluntarily allows the so-called beam split attack because Eve splits a single photon from multi-photon pulses or blocks all single photon pulses and only allows multi-photon pulses transmitted to Bob, she can then accurately know the key bits by measuring her stored photons after she learns the measurement types from the public channel by which Bob publicly tells Alice his measurement type for each pulse.

Moreover, most practical QKD systems to date employ a multi-photon source, such as a laser, and attenuate multi-photon pulses to achieve single-photon quantum signals to a level 0.1 or 0.2 photon per pulse. The photon distribution is governed by Poisson distribution, so there are pulses containing more than one photon. Effort is made to suppress or discard the multi-photon signals generated by the single-photon source, but one photon-per-bit key distribution is impractical. In other words, in order to avoid transmitting more than one photon, the attenuator must be set such that about 50-90% of the attempted pulses generate zero photons. An attack on the multiple-photon pulses can prove very effective for Eve if she can take advantage of the large channel loss. Thus, the ability to detect Eve changing the efficiency of the delivery of single versus multi-photon pulses from Alice to Bob is the crucial element in maintaining system security in the presence of loss.

US Publication 2003/0169880 describes a quantum cryptography key distribution system for sharing a secret key between a transmitter and a receiver site. An unbalanced interferometer system in the transmitter site has a Mach-Zehnder interferometer switch with a phase modulator while the receiver site records photon arrival time slots. The system utilizes a whole arrival of photons in the receiver site and dispenses with any phase modulator in the receiver site. However, this method still depends on the classical authentication before key distribution.

US Publication 2007/0071244 describes a quantum key distribution station having the capability of forming decoy signals randomly interspersed with quantum signals as part of a QKD system. The QKD station includes a polarization-independent high-speed optical switch adapted for use as a variable optical attenuator. The high-speed optical switch has a first attenuation level that results in first outgoing optical signals in the form of quantum signals having a mean photon number $\mu_Q$, and a second attenuation level that results in second outgoing optical signals as decoy signals having a mean photon number PD. This system, however, requires complex optical switch.

Therefore, there is a need for a system and a method having an overall unconditional secure quantum key distribution including an unconditional secure authentication though quantum channel and unconditional key distribution. There is a further need for an overall unconditional secure quantum key distribution not be limited to a single photon source.

SUMMARY OF THE INVENTION

In accordance with one aspect of the invention there is provided a quantum cryptography authentication system. The quantum cryptography authentication system comprises an optical link connecting a sender and a receiver. The sender transmits a first optical pulse and a second optical pulse, with a defined time delay between them. The first pulse is modulated with a first authentication phase shift; the second pulse is modulated with phases selected from one basis of two non-orthogonal bases, and encoded with one of two orthogonal states within the one basis based on an information of the sender. The second pulse is further modulated with a second authentication phase shift. The receiver comprises a first splitter receiving and splitting the first pulse into a third pulse and a fourth pulse, and the second pulse into a fifth pulse and a sixth pulse. The fourth pulse and the sixth pulse are sent to a first optical reference loop and modulated with the first authentication phase shift; and the third pulse and the fifth pulse are sent to a first optical delay loop and modulated with the second authentication phase shift. The receiver further includes a first coupler connected to the first optical reference loop and the first optical delay loop. The first coupler combines the third pulse, the fourth pulse, the fifth pulse, and the sixth pulse. The third pulse and the sixth pulse arrive at the first coupler simultaneously. The receiver further includes a first set of detectors receiving the combined third pulse and sixth pulse, determining the one basis of the two non-orthogonal bases; and a second set of detectors receiving the combined third pulse and sixth pulse, and determining the one of the two orthogonal states within the basis and thereby decoding the information of the sender.

Preferably, the sender comprises an optical source generating an optical pulse; and a second splitter connected to a second optical reference loop and a second optical delay loop. The second splitter receives and splits the optical pulse into the first pulse and the second pulse. The first pulse is sent to the second optical reference loop and modulated with the first authentication phase shift; the second pulse is sent to the second optical delay loop, and modulated with the information of the sender and the second authentication phase shift. The sender further comprises a second coupler connected to the second optical reference loop and the second optical delay loop. The second coupler collects the first pulse and the second pulse. The second coupler is connected to the first end of the optical link and transmitting the first pulse and the second pulse to the optical link.

Preferably, the third pulse and the fifth pulse are horizontally polarized, and the fourth and sixth pulse are vertically polarized.

Preferably, the third pulse and the fifth pulse are vertically polarized, and the fourth and sixth pulse are horizontally polarized.

Preferably, the quantum cryptography authentication system comprises a first wave plate and a third splitter for passing the combined third pulse and sixth pulse to the first set of detectors.

Preferably, the quantum cryptography authentication system comprises a second wave plate and a third splitter for passing the combined third pulse and sixth pulse to the second set of detectors.

Preferably, at least one of the first splitter, the third splitter and the fourth splitter is a polarization beam splitter.

Preferably, the first authentication phase shift is a device authentication phase shift, and the second authentication phase shift is a user authentication phase shift.

Preferably, at least one of the first optical reference loop, the first optical delay loop, the second optical reference loop, and the second optical delay loop includes an optical loop characteristic adjuster.

Preferably, the optical source generates weak coherent optical pulse.

Preferably, characteristics of the first optical delay loop match characteristics of the second optical delay loop.

Preferably, the non-orthogonal bases comprising orthogonal states in Hilbert space with equal phase differences between two neighboring phases.

Preferably, the non-orthogonal bases are $(0, \pi)$ and $(\pi/2, 3\pi/2)$.

Preferably, one of the first wave plate and the second wave plate is a $\lambda/2$ plate, and the other is a $\lambda/4$ plate.

In accordance with another aspect of the invention there is provided a receiver in a quantum cryptography authentication system. The receiver comprises a first splitter splitting a received first optical pulse into a third pulse, and a fourth pulse, and a received second optical pulse, into a fifth pulse and a sixth pulse. The received first optical pulse and the received second optical pulse have a defined time delay therebetween. The second pulse is modulated with phases selected from one basis of two non-orthogonal bases, and encoded with one of two orthogonal states within the one basis based on an information of a sender. The fourth pulse and the sixth pulse are sent to an optical reference loop; the third pulse and the fifth pulse are sent to an optical delay loop. The receiver further includes a coupler connected to the optical reference loop and the optical delay loop, the coupler combines the third pulse, the fourth pulse, the fifth pulse and the sixth pulse; whereby the third pulse and the sixth pulse arrive at the coupler simultaneously. The receiver further includes a first set of detectors receiving the combined third pulse and sixth pulse, and determining the one basis of the two non-orthogonal bases; and a second set of detectors receiving the combined third pulse and sixth pulse, and determining the one of the two orthogonal states within the basis and thereby decoding the information of the sender.

Preferably, the third pulse and the fifth pulse are horizontally polarized, and the fourth and sixth pulse are vertically polarized.

Preferably, the receiver further comprises a first wave plate and a second splitter for passing the combined third pulse and sixth pulse to the first set of detectors.

Preferably, the receiver further comprises a second wave plate and a fourth splitter for passing the combined third pulse and sixth pulse to the second set of detectors.

Preferably, at least one of the first splitter, the second splitter and the third splitter is a polarization beam splitter.

In accordance with another aspect of the invention there is provided a method of authenticating a sender comprising the steps of: generating an optical pulse; splitting the optical pulse into a first pulse and a second pulse; transmitting the first pulse to a first optical reference loop and the second pulse to a first optical delay loop; modulating the first pulse with a first authentication phase shift; modulating the second pulse with phases selected from one basis of two non-orthogonal bases, and encoded with one of two orthogonal states within the one basis based on an authentication information of the sender; modulating the second pulse with a second authentication phase shift; collecting the first pulse and the second pulse at a first coupler connected to an optical link and transmitting the first pulse and the second pulse to a receiver; receiving and splitting the first pulse into a third pulse and a fourth pulse, and the second pulse into a fifth pulse and a sixth pulse at the receiver; sending the fourth pulse and the sixth pulse to a second optical reference loop; modulating the fourth pulse and the sixth pulse with the first authentication phase shift; sending the third pulse and the fifth pulse to a second optical delay loop; modulating the third pulse and the fifth pulse with the second authentication phase shift; combining the third pulse, the fourth pulse, the fifth pulse and the sixth pulse; the third pulse and the sixth pulse arriving at the second coupler simultaneously; receiving the combined third pulse and sixth pulse at a first set of detectors; determining the one basis of the two non-orthogonal bases; receiving the combined third pulse and sixth pulse at a second set of detectors; and determining the one of the two orthogonal states within the basis and thereby decoding the information of the sender.

BRIEF DESCRIPTION OF THE DRAWINGS

These and other features of the invention will become more apparent from the following description in which reference is made to the appended drawings wherein:

FIG. 2(*b*) is a table illustrating an eight-bit example of BB84 protocol quantum key distribution;

FIG. 6(*e*) shows the delay in time domain between the different pulses.

DETAILED DESCRIPTION OF PREFERRED EMBODIMENTS

Figures 1, 2:
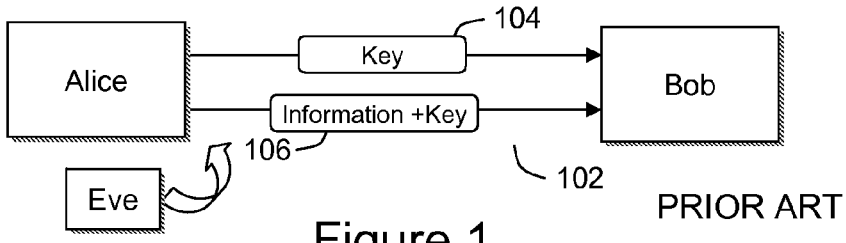
PRIOR ART Figure 1
Figure 2 PRIOR ART
FIG. 1 shows an exemplary communication between two parties.
FIG. 2(*a*) illustrates possible states of a single photon in two non-orthogonal bases.

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations have not been described in detail in order not to unnecessarily obscure the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Those skilled in the art will appreciate that the invention may be practiced with many computer system configurations, including personal computers, hand-held devices, multi-processor systems, microprocessor-based or programmable consumer electronics, network PCs, minicomputers, mainframe computers and the like. The invention may also be practiced in distributed computing environments where tasks are performed by remote processing devices that are linked through a communications network. In a distributed computing environment, program modules may be located in both local and remote memory storage devices.

Although not required, the invention will be described in the general context of computer-executable instructions, such as program modules, being executed by a personal computer. Generally, program modules include routines, programs, objects, components, data structures and the like that perform particular tasks or implement particular abstract data types.

In accordance with one embodiment of the present invention there is provided a practical unconditional quantum key cryptography: key distribution together with device and user authentications. In the description below, one-way phase encoding is used in order to avoid back-scatter. However, it should be apparent to a person skilled in the art that another scheme, for example, but not limited to round-trip phase encoding scheme can also be used.

Figure 3:
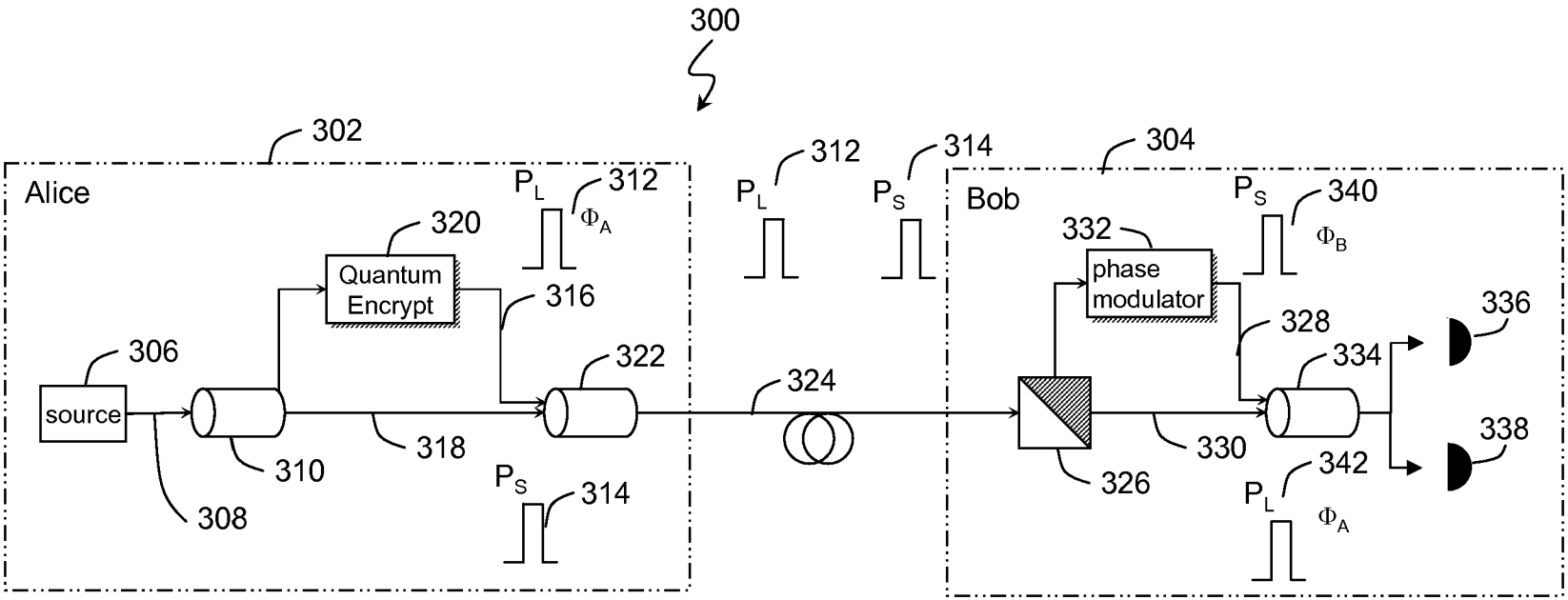
Figure 3 PRIOR ART
FIG. 3 shows a prior art quantum cryptography key distribution system.

Referring to FIG. 3, in a conventional system 300 employing a one-way phase encoding QKD scheme, a sender (Alice) 302 and a receiver (Bob) 304 are shown.

Alice 302 has an optical source 306 for generating an optical signal 308, for example, a laser diode for providing laser pulses. The optical signal 308 is separated or split by a beam splitter, for example, a 3 dB splitter 310 into two optical signals 312 and 314, to be delivered to a long optical loop 316 and a short optical loop 318. In the long optical loop 316, a phase modulator 320 is inserted. In the phase modulator 320, each optical pulse 312 periodically received from the light source 306 is phase modulated by selecting a random quantum encoding basis, for example, bits 0 and 1 are encoded as 0, π in basis 1, and π/2, 3π/2 in basis 2, respectively. The phase shift $\phi_A$ in pulse $P_L$ will have a value that is characterized by a quantum encoding basis and a polarity. The quantum encoding basis is random and is known only to Alice 302. After selecting the quantum encoding basis, the polarity, i.e., whether the phase shift $\phi_A$ will be 0 or π encoded as 0, π in basis 1, or π/2 or 3π/2 in basis 2, depends on the value of the given quantum key bit that Alice 302 is transmitting. After having passed through the phase modulator 320, pulse $P_L$ will have a phase shift of $\phi_A$. The other pulse $P_S$ 314 in the short optical loop 318 is a reference pulse.

It should be apparent to a person skilled in the art that the reference signal may travel the long optical loop and the other optical signal may be phase modulated in a phase modulator in the short optical loop.

The optical signals, for example, laser pulses $P_L$ 312 and $P_S$ 314 are then combined together by a combiner 322, for example a coupler. The combined signal is then transmitted to Bob 304, through, for example, an optical channel 324.

When the combined signal reaches Bob 304, the received combined signal is branched or split by a splitter 326 to be delivered to a long optical loop 328 and a short optical loop 330. The characteristics of the optical delay path of long optical loop 328 at receiver 304 is generally identical with that of the long optical loop 316 at the sender 302, with a phase modulator 332 inserted in the long optical loop 328.

Bob 304 will modulate a phase shift $\phi_B$ into $P_S$ 314, selected basis on randomly chosen quantum encoding basis, 0 for basis 1 and π/2 for basis 2, resulting in pulse $P_S$ 340.

Pulses $P_S$ 340 and $P_L$ 342 arrive at Bob's coupler 334 at the same time because the characteristics of the optical delay path of long optical loop 328 at receiver 304 is generally identical with that of the long optical loop 316 at the sender 302. Therefore, the two pulses $P_S$ 340 and $P_L$ 342 combine at coupler 334 to form a composite pulse having a phase shift of $\Delta\phi=\phi_B-\phi_A$ by interference.

In the event that the quantum encoding basis used by Alice's phase modulator 320 matches the quantum encoding basis used by Bob's phase modulator 332, the composite pulse will cause a measurement to be recorded at only one of the detectors 336 or 338. Which of the detectors 336 and 338 records a measurement will depend only on whether the polarity used by Bob's phase modulator 332 matches the polarity used by Alice's phase modulator 320. If their phase difference is 0, the combined pulse is a linear polarization in a 45° direction and will be detected by detector 336. If the phase difference is π, the combined pulse is also a linear polarization in −45° direction and will be detected by detector 338.

It is possible to extract, from the whole of the records, the records corresponding to the photons that are subjected to the phase modulation of $\phi_B-\phi_A=0, \pi$, and that would bring about the deterministic results. Thus, the extracted records are equal to a half of the whole records and specify a complete correlation between the records of the phase modulation values $\phi_A$ in Alice and the records of the photon detection ports in Bob. Accordingly, it is possible to share, between Alice and Bob, the secret key consisting of a series of random bits by appropriately assigning 0/1 to the phase modulation values $\phi_A$ and the photon detection records of Bob.

In the event that the quantum encoding basis used by Alice's phase modulator 320 does not match the quantum encoding basis used by Bob's phase modulator 332, each photon in the composite multi-photon pulse will be picked up by either detector 336 or detector 338 with approximately equal probability, as the interference is neither constructive nor destructive, which results in a measurement being recorded at both of the detectors 336 and 338.

Figure 4:
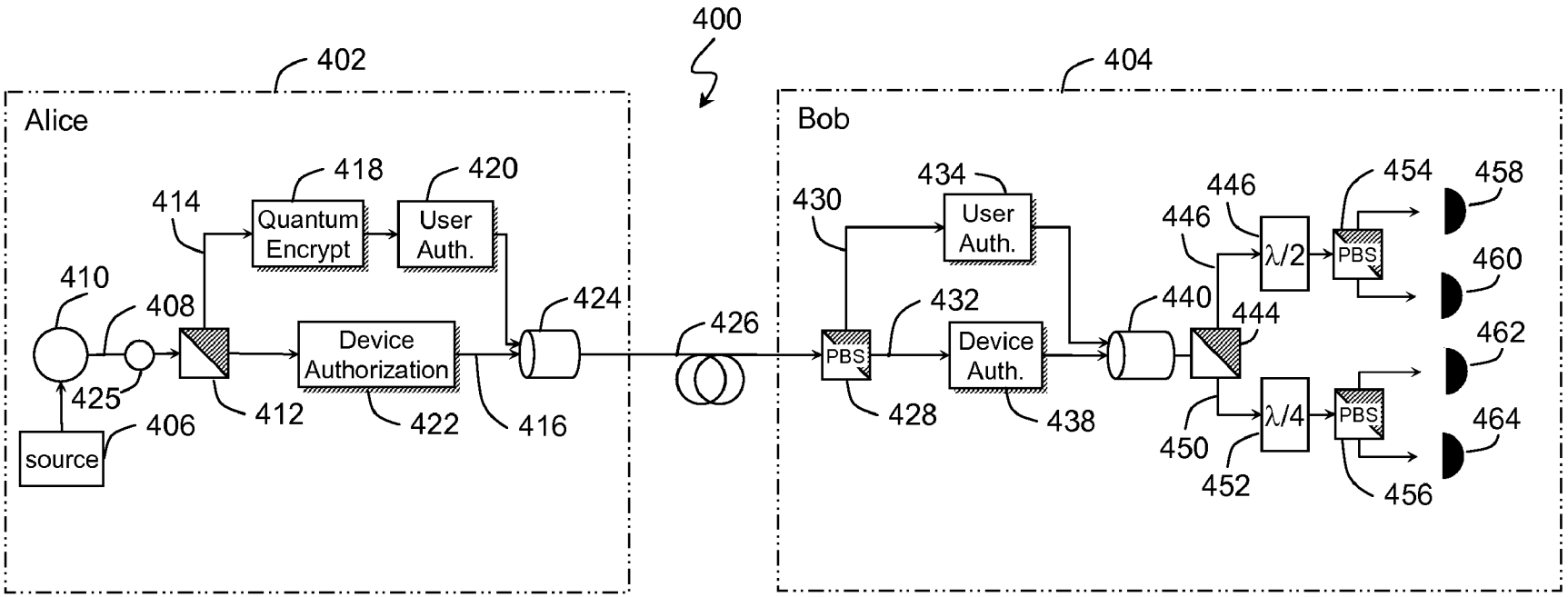
FIG. 4 shows a quantum cryptography authentication system in accordance with one embodiment of the present invention.

Referring now to FIG. 4, a system 400 in accordance with one embodiment of the present invention is described.

The sender (Alice) 402 has an optical signal generating means 406, for example, an optical source for generating an optical signal 408. The optical signal may be a single photon, or weak coherent pulses (WCP) as an approximation of the single photon. However, as will be apparent to a person skilled in the art with the following description, this embodiment is not limited to weak coherent pulses or any other low-intensity coherent light pulses. Rather, coherent light pulses of other intensities may also be used. The optical signal generating means 406 may include, for example, a laser diode, and a circulator 410 to provide laser pulses.

The optical signal 408 is split by a optical signal splitting means 412, for example, a beam splitter including but not limited to a 3 dB fiber coupler into two optical signals, to be delivered to an optical delay loop, for example but not limited to, a long optical loop 414 and a optical reference loop, for example but not limited to, a short optical loop 416. In the optical delay loop 414, a phase modulator 418 may be inserted. In the phase modulator 418, each optical pulse periodically received from the optical signal generating means 406 is phase modulated by selecting a random basis, for example, bits 0 and 1 are encoded as 0, π in basis 1, and π/2, 3π/2 in basis 1, respectively. It should be apparent to a person skilled in the art that the encoding bits in basis 1 (0, π) and basis 2 (π/2, 3π/2) is for illustration purposes only. Any four states in two non-orthogonal bases, each of which has two orthogonal states, can be used to implement BB84 protocol. Non-orthogonal states are described in the above identified Physical Review Letters by Bennett as "Let $|\mu_0>$ and $|\mu_1>$ be two distinct, non-orthogonal states, and let $P_0=1-|\mu_1><\mu_1|$ and $P_1=1-|\mu_0><\mu_0|$ be (non-commuting) projection operators onto subspaces orthogonal to $|\mu_1>$ and $|\mu_0>$, respectively (note reversed order of indices). Thus $P_0$ annihilates $|\mu_1>$, but yields a positive result with probability $1-|<\mu_0|\mu_1>|^2>0$ when applied to $|\mu_0>$, and vice versa for $P_1$". Therefore, quantum states in Hilbert space with equal phase differences between two neighboring phases may be used, for example, in case of a four-phase state in Hilbert space: 0, π/2, π, 3π/2 or π/4, 3π/4, 5π/4 and 7π/4; in case of an eight-phase state in Hilbert space: π/8, 3π/8, 5π/8, 7π/8, 9π/8, 11π/8, 13π/8, and 15π/8. In general, the higher the number of sets of bases, the greater the potential level of security.

The optical delay loop 414, in accordance with one embodiment of the present invention, may further include a second phase modulator 420 based on a user (Alice's) authentication key.

The other optical signal in the optical reference loop 416 may be considered as a reference signal. In accordance with one embodiment of the present invention, the optical reference loop 416 further includes a third phase modulator 422. The phase modulator 422 is used to modulate a phase in the reference signal to change its initial phase, and is based on Alice's device authentication key. Advantageously, the reference signal in the QKD is no longer a reference known by anyone except Bob who shares the device authentication key with Alice.

It should be apparent to a person skilled in the art that a number of variations and modifications can be made without departing from the scope of the invention. For example, the phase modulator 422 modulating the optical signal based on the device authentication key may reside on any one of the optical reference loop 416 and optical delay loop 414. Likewise, the phase modulator 420 modulating the optical signal based on the user authentication key may reside on any one of the optical reference loop 416 and the optical delay loop 414. Furthermore, the two functions of the two phase modulators 418, 420 in the optical delay loop 414 may performed by a single modulator.

The optical signals, for example, laser pulses are then combined together by a combiner 424, for example a coupler. The combined optical signal is then transmitted to the receiver (Bob) 404, through, for example, an optical channel 426. Optionally, the combined optical signal may further be attenuated by an attenuator 425 into low-intensity coherent light pulses.

When the combined signal reaches the receiver (Bob) 404, the received combined signal is split by a beam splitting means, for example but not limited to, a polarization beam splitter 428 to be delivered to a optical delay loop 430 and a optical reference loop 432. The characteristics of the optical delay loop 430 at Bob 404 are preferably identical with that of the optical delay loop 414 at Alice 402, and the characteristics of the optical reference loop 432 at Bob 404 are preferably identical with that of the optical reference loop 416 at Alice 402. Alternatively, optical loop characteristic adjustor, for example but not limited to, optical loop length adjuster, may be used to adjust, for example but not limited to, the lengths of the optical loops at Alice or Bob, or both, so that the characteristics of the optical delay loop 430 at Bob 404 are matched with that of the optical delay loop 414 at Alice 402, and the characteristics of the optical reference loop 432 at Bob 404 are matched with that of the optical reference loop 416 at Alice 402.

The optical delay loop 430 in Bob includes a phase modulator 434 which modulates a phase shift based on the user authentication key, as Bob shares Alice's user authentication key. The optical reference loop 432 in Bob includes a phase modulator 438 which modulates the same device authentication key into the optical signal, as Bob shares Alice's device authentication key.

The optical signals from the optical reference loop 432 and optical delay loop 430 arrive at Bob's coupler 440 at the same time because characteristics of the optical delay loop 430 at Bob 404 are preferably identical with that of the optical delay loop 414 at Alice 402, and the characteristics of the optical reference loop 432 at Bob 404 are preferably identical with that of the optical reference loop 416 at Alice 402. Therefore, the two optical signals combine at coupler 440 to form a composite pulse as described below.

Figure 5:
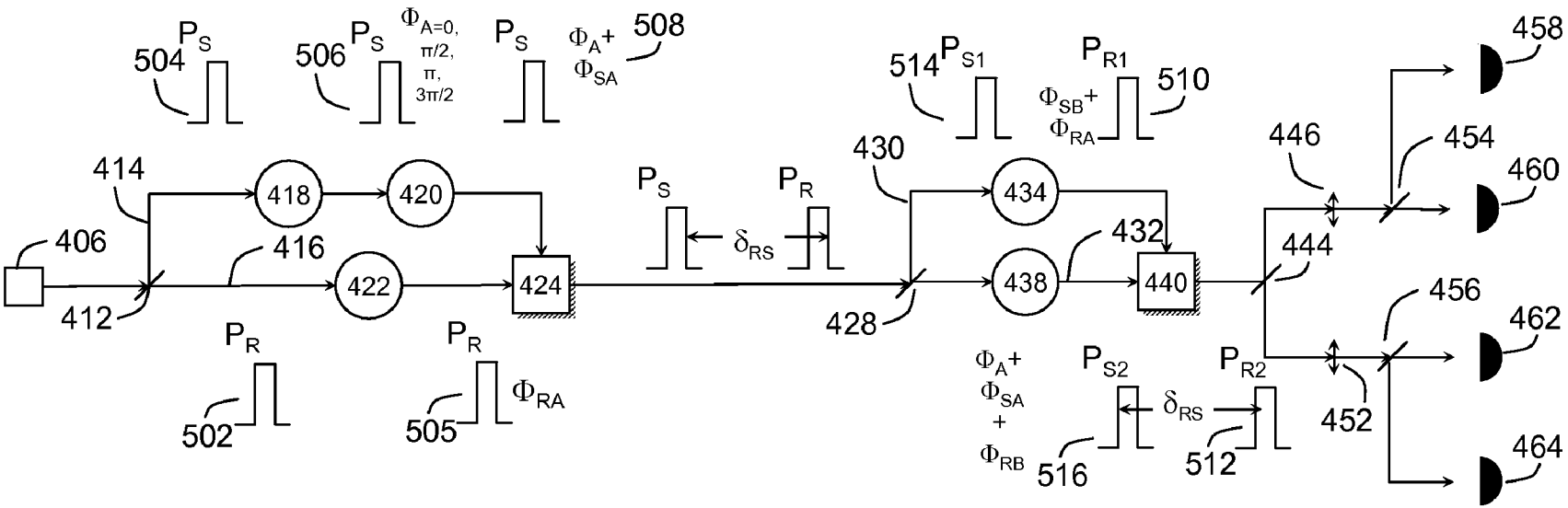
FIG. 5 shows the phase shift modulation in a quantum cryptography authentication system of FIG. 4.

In operation, and referring to FIGS. 4 and 5, at Alice 402, an optical source 406, for example, a laser diode emits an optical signal 408 in the form of a sequence of light pulses. The pulses 408 are split by an optical signal splitting means, for example, but not limited to, a 50-50 coupler 412 to be delivered to the optical delay loop 414 and an optical reference loop 416. Pulse $P_R$ 502 takes the optical reference loop 416 and $P_S$ 504 takes the optical delay loop 414. After passing the phase modulator 422, $P_R$ 505 is modulated by a phase $\phi_{RA}$ based on, for example but not limited to, Alice's device authentication key.

In the optical delay loop 414, $P_S$ is first modulated in the phase modulator 418 for key encoding. In the phase modulator 418, each optical pulse periodically received from the optical source 406 is phase modulated by a value $\phi_A$ that is selected from, for example, but not limited to, four values, namely, 0, $\pi$ in basis 1, and $\pi/2$, $3\pi/2$ in basis 2, generated at random, resulting in pulse $P_S$ 506. $P_S$ 506 is then modulated by an authentication phase $\phi_{SA}$ in phase modulator 420, based on the user authentication key, resulting in pulse $P_S$ 508. Phase modulation using the user authentication key mapping may be the same as phase modulation for device authentication key, or different. Furthermore, phase modulator 418 and user authentication phase modulators 420 may be combined into one and then the joint phase will be modulated into the $P_S$.

Pulse $P_R$ 505 and pulse $P_S$ 508 reach Bob's beam splitting means, for example but not limited to, a polarization beam splitter (PBS) 428 with a time delay of $\delta_{RS}$ which correspond to the time difference for an optical signal to travel between the optical delay loop 414 and the optical reference loop 416. The polarization beam splitter 428 splits both $P_R$ and $P_S$ into: $P_{R1}$ 510 and $P_{R2}$ 512, $P_{S1}$ 514 and $P_{S2}$ 516, respectively. By way of example, the $P_{R1}$ 510 and $P_{S1}$ 514 may be polarized in the horizontal direction, while $P_{R2}$ 512, and $P_{S2}$ 516 may be polarized in the vertical direction. It should be apparent to a person skilled in the art that polarization directions may be different for the split pulses, for example, $P_{R2}$ 512, and $P_{S2}$ 516 may be polarized in the horizontal direction and $P_{R1}$ 510 and $P_{S1}$ 514 may be polarized in the vertical direction, while still adhere to the principle of the embodiment of the present invention. The horizontal polarization pulses $P_{R1}$ 510 and $P_{S1}$ 514 are sent into the optical delay loop 430 which has a delay in the amount substantially the same as in Alice's optical delay loop 414. Alternatively, adjusting means, for example but not limited to, an adjustable delay loop, may be included in the optical delay loop 430 to adjust the delay. Both $P_{R1}$ 510 and $P_{S1}$ 514 are modulated a phase shift based on the user authentication key $\phi_{SB}$ in the phase modulator 434, the user authentication key is identical to the one used in Alice 402. Vertical polarization pulses $P_{R2}$ 512, and $P_{S2}$ 516 take the optical reference loop 432 and are modulated in a device authentication phase shift $\phi_{RB}$ in the phase modulator 438.

Figure 6:
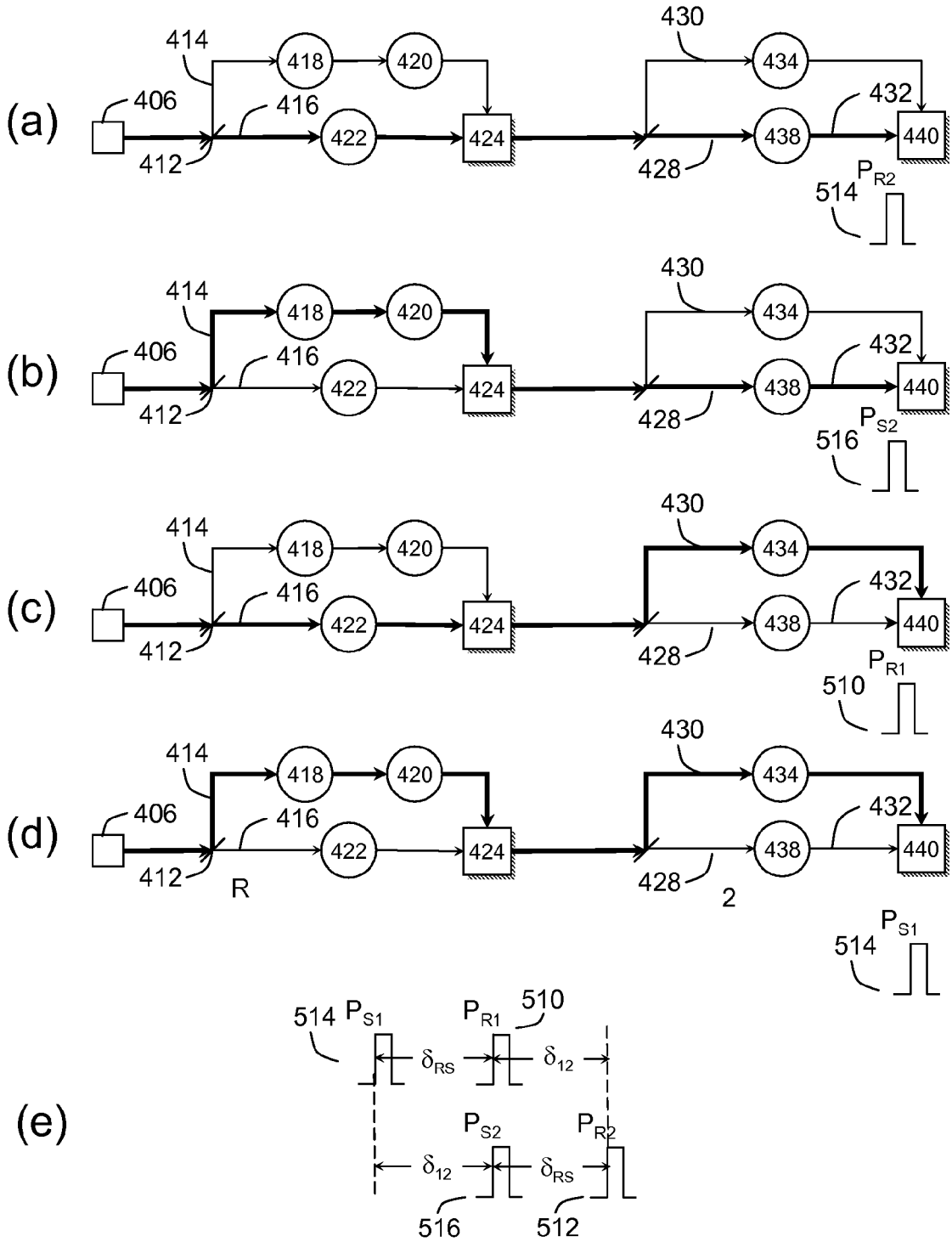
FIG. 6(*a*) to (*d*) illustrate four paths of different lengths from the source to the coupler at the destination.

The pulses in the optical signal 408 are transmitted from the optical signal generating means 406 at Alice 402 to the coupler 440 at Bob 404 through four paths of different lengths. The pulses travelling the first path include the optical reference loop 416 of Alice 402 and the optical reference loop 432 of Bob 404 as illustrated by the bold lines in FIG. 6(*a*), and arrive first at the coupler 440 first as $P_{R2}$ 512. The pulses travelling the second path include the optical delay loop 414 of Alice 402 and the optical reference loop 432 of Bob 404 as illustrated by the bold lines in FIG. 6(*b*), and arrive at the coupler 440 as $P_{S2}$ 516. The pulses travelling the third path include the optical reference loop 416 of Alice 402 and the optical delay loop 430 of Bob 404 as illustrated by the bold lines in FIG. 6(*c*), and arrive at the coupler 440 as $P_{R1}$ 510. The pulses travelling the fourth path include of the optical delay loop 414 of Alice 402 and the optical delay loop 430 of Bob 404 as illustrated by the bold lines in FIG. 6(*d*), and arrive last at the coupler 440 first as $P_{S1}$ 514. As illustrated in FIG. 6(*e*), the time delays between $P_{R2}$ and $P_{R1}$, $P_{S2}$ and $P_{S1}$ are $\delta_{12}$, respectively. Likewise, and the time delays between $P_{R1}$ and $P_{S1}$, $P_{R2}$ and $P_{S2}$, are $\delta_{RS}$, respectively. Because the characteristics of the optical delay loop 430 at Bob 404 are preferably identical with that of the optical delay loop 414 at Alice 402, and the characteristics of the optical reference loop 428 at Bob 404 are preferably identical with that of the optical reference loop 416 at Alice 402, the pulses $P_{R1}$ and $P_{S2}$ arrive at the coupler 440 at Bob 404 at the same time. The pulse $P_{R2}$ arrives at the coupler 440 at Bob 404 $\delta_{12}$ ($=\delta_{RS}$) before the pulses $P_{R1}$ and $P_{S2}$, and the $P_{S2}$ arrives at the coupler 440 at Bob 404 $\delta_{12}$ ($=\delta_{RS}$) after the pulses $P_{R1}$ and $P_{S2}$.

At the coupler 440, vertical polarized pulse $P_{S2}$ has a total phase shift ($\phi_{S2}$) applied by the phase modulator 418 ($\phi_A$) and the second phase modulator 420 based on the user authentication key ($\phi_{SA}$) at Alice 402 and the device authentication key phase modulator 438 at Bob 404 ($\phi_{RB}$):

$$\phi_{S2}=\phi_A+\phi_{SA}+\phi_{RB}$$

Horizontal polarized pulse $P_{R1}$ has a total phase shift ($\phi_{R1}$) applied by the phase modulator 422 ($\phi_{RA}$) at Alice 402 and the user authentication key phase modulator 434 at Bob 404 ($\phi_{SB}$):

$$\phi_{R1}=\phi_{RA}+\phi_{SB}$$

Phase difference between pulse $P_{S2}$ and pulse $P_{R1}$ at Bob's coupler 440 is:

$$\Delta\phi = \phi_{S2} - \phi_{R1}$$
$$= \phi_A + \phi_{SA} + \phi_{RB} - (\phi_{RA} + \phi_{SB})$$

Because the characteristics of the optical delay loop 430 at Bob 404 are preferably identical with that of the optical delay loop 414 at Alice 402, and the characteristics of the optical reference loop 428 at Bob 404 are preferably identical with that of the optical reference loop 416 at Alice 402, $$\phi_{RA}=\phi_{RB}$$

$$\phi_{SA}=\phi_{SB}, \text{ and}$$

$$\Delta\phi=\phi_A$$

The combined pulse vertical polarized $P_{S2}$ and horizontal polarized pulse $P_{R1}$ are 50/50 split at beam splitter 444. One signal 450 may pass a $\pi/2$ wave plate 452 (basis 2). Optionally, signal 446 may pass a $\lambda/2$ ($=\pi$) wave plate 446 (basis 1)

From the optional $\pi$ wave plate 446 and the $\pi/2$ wave plate 452 the pulses are in turn split into two set of pulses by the polarization beam splitters 454 and 456, respectively. One set of detectors 458 and 460 are used for detecting the pulse having a phase shift in basis 1, for example, pulse modulated by 0 or $\pi$. The probability of detecting, at the detector 458 is given by:

$$P(D_{458})=(1/2)(1+\cos\Delta\phi)$$

the probability of detecting, at the detector 460 is given by:

$$P(D_{460})=(1/2)(1-\cos\Delta\phi)$$

Therefore, the pulses corresponding to $\Delta\phi=0$ or $\pi$ are directed to the detectors 458 or 460 at a deterministic probability of 1 while the pulses corresponding to $\pi/2$, $3\pi/2$ is directed to detectors 462 or 464 at a deterministic probability of 1/2.

The other set of the detectors 462 and 464 detects the pulses passed a $\pi/2$ wave plate. The probability of detecting, at the detector 462 is given by:

$$P(D_{462})=(1/2)(1+\cos(\Delta\phi+\pi/2))$$

the probability of detecting, at the detector 464 is given by:

$$P(D_{464})=(1/2)(1-\cos(\Delta\phi+\pi/2))$$

Therefore, the pulses corresponding to $\Delta\phi=\pi/2$, $3\pi/2$ is directed to the detectors 462 or 464 at a deterministic probability of 1 while the pulses corresponding to 0 or $\pi$, is directed to detectors 458 or 460 at a deterministic probability of 1/2.

As described in the above, at any given time, one set of the detectors will show simultaneous detection, this is the so-called "two-click" which indicates a wrong basis. The other set of the detectors will have one detector detecting a pulse, which the other detector in the set remains silent. This is the so-called "one-click" which indicates a correct basis and also reveals the encoded key bit.

Pulse $P_{R2}$ and pulse $P_{S1}$ may be used to provide timing and/or synchronization information. Pulse $P_{R2}$ may also be used to trigger the data retrieve circuit to begin collect data, and pulse $P_{S1}$ may be used to close the data retrieve circuit.

The embodiment of the present invention provides a novel approach to authenticate a remote sender (Alice) 402 for Bob 404. Using the two sets of detectors for two non-orthogonal bases, Bob 404 is able to identify the basis used by Alice 402, as well as the value of the key bits sent by Alice 402. When laser pulses of general intensity are used, quantum statistic guarantees that if the basis is correctly selected, there is only one detector that makes record. That means, for the two sets of detectors, only one set has a so-called one-click and the other must be a two-click. Therefore, Bob's measurement is accurate; there is no need to exchange measurement types or measurement results.

In practice, the attenuator 425 at Alice 402 may be used to attenuate the intensity of the optical source 406 to a level that makes Bob's one set of detectors have "double clicks" and the other set "one click".

The use of the user authentication key and device authentication provides additional security to the communication. Referring to FIGS. 4 and 5, after leaving Alice 402, $P_R$ has device authentication key phase shift $\phi_{RA}$ and $P_S$ carries key bit mapped phase shift $\phi_A$, together with user authentication key phase shift $\phi_{SA}$. Both $P_R$ and $P_S$ may be easily split by an eavesdropper ("Eve"). However, Eve cannot exactly measure the device authentication phase because she does not know the initial phase of the pulse $P_R$. She also cannot measure the combined phase shift $\phi_{SA}+\phi_A$ in $P_S$. If she wants to measure individual pulse, she can at most get the phase difference between her local laser oscillator and each individual pulse. That difference contains both the initial phase and the modulated phase and her local laser pulse. From the phase shifts, she cannot get any key information if the Hilbert phase space is selected to randomize the quantum state. For example, the key encoding phase space includes 0, $\pi/2$, $\pi$, $3\pi/2$ and the Hilbert phase space for the user authentication is spanned by $\pi/4$, $3\pi/4$, $5\pi/4$ and $7\pi/4$. Any key phase shift, i.e. a quantum state, can be transformed to one of the four phases of the user authentication transformation. For example, $\pi/2$ is transformed by a user authentication key operation $3\pi/4$. The transformed phase shift is $\pi/2+3\pi/4=5\pi/4$. Even if Eve determines, although unlikely, the phase shift from $P_S$, is $5\pi/4$, it cannot be determined what the key bit is, $5\pi/4$ can be equal to either $\pi/2+3\pi/4$ or $\pi+\pi/4$. The phase $\pi/2$ represents 0 in basis 2 and $\pi$ represents 1 in basis 1.

Figure 7:
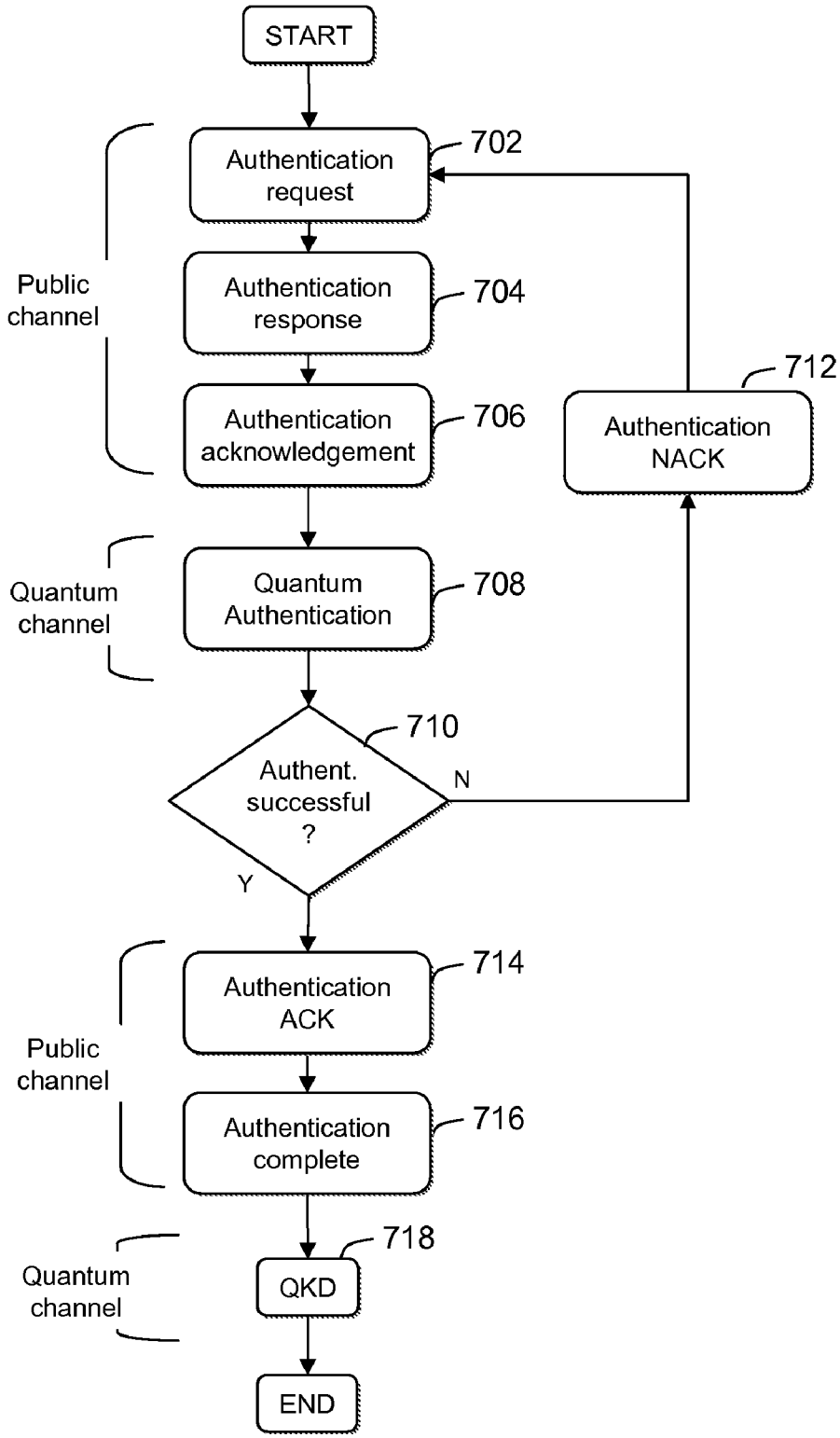
FIG. 7 shows the steps of an authentication method in accordance with one embodiment of the present invention.

FIG. 7 illustrates an authentication process using one embodiment of the present invention. Also referring to FIG. 4, at step 702 an authentication request is sent from Bob 404 to Alice 402 over public channel. Alice responds 704 in the public channel to Bob and indicates she is ready to start authentication process. Optionally, Bob may send an acknowledgement 706, also in the public channel.

Alice begins the authentication 708 in the quantum channel by modulating a phase shift based on the device authentication key bit stream in pulse $P_R$ in the short optical loop 416, and selects bases for quantum encoding for the key bit of authentication message, and incorporates a phase shift based on the key bit and a phase shift based on the user authentication key in the optical delay loop 414; Bob 404 modulates a phase shift based on the device authentication key in the optical reference loop 432 and a phase shift based on the user authentication key in the optical delay loop 430, as described earlier.

If Bob cannot decode the authentication message 710 from Alice, the authentication fails. Bob sends authentication-NACK over public channel with indication of failure 712.

Then there is no key exchange. Bob may try another authentication request 702.

If Bob can decode the authentication message from Alice, the authentication is successful. Bob then sends the authentication-ACK 714 over public channel with the authentication message XOR device authentication key bit stream XOR user authentication key bit stream) to Alice. Based on the received with the authentication-ACK from Bob, Alice completes the authentication step 716, and continues with quantum key distribution 718.

Although the embodiments described in the above are for point-to-point, it can be directly applied for point-to-multiple-point (P2MP): one Alice and multiple Bob's. After the authentication process completes, the device authentication key and user authentication key can be refreshed with the successfully exchanged keys in the quantum channel. Then the device authentication key and user authentication key are used only once in the classical communication between Alice and Bob. The one-time-pad rule is not broken. Furthermore, the device authentication key and user authentication key can be regularly updated with the successfully exchanged keys in the quantum channel during system operation.

The embodiments of the present invention can improve QKD key bit rate, as well as extend its distance, as the method disclosed here can be used for intensity laser without compromising the security.

Because the embodiments of the present invention combine key bit encoding, device and user authentication into each individual laser pulse, the communication system is protected from man-in-the-middle attack, beam split attack, intercept-and-resend attack, etc. Therefore, it provides an overall unconditional security for both authentication and key distribution.

Embodiments within the scope of the present invention can be implemented in digital electronic circuitry, or in computer hardware, firmware, software, or in combinations thereof. Apparatus within the scope of the present invention can be implemented in a computer program product tangibly embodied in a machine-readable storage device for execution by a programmable processor; and method actions within the scope of the present invention can be performed by a programmable processor executing a program of instructions to perform functions of the invention by operating on input data and generating output. Embodiments within the scope of the present invention may be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random-access memory. Generally, a computer will include one or more mass storage devices for storing data files. Embodiments within the scope of the present invention include computer-readable media for carrying or having computer-executable instructions, computer-readable instructions, or data structures stored thereon. Such computer-readable media may be any available media, which is accessible by a general-purpose or special-purpose computer system. Examples of computer-readable media may include physical storage media such as RAM, ROM, EPROM, CD-ROM or other optical disk storage, magnetic disk storage or other magnetic storage devices, or any other media which can be used to carry or store desired program code means in the form of computer-executable instructions, computer-readable instructions, or data structures and which may be accessed by a general-purpose or special-purpose computer system. Any of the foregoing can be supplemented by, or incorporated in, ASICs (application-specific integrated circuits). While particular embodiments of the present invention have been shown and described, changes and modifications may be made to such embodiments without departing from the true scope of the invention.

The present invention has been described with regard to one or more embodiments. However, it will be apparent to persons skilled in the art that a number of variations and modifications can be made without departing from the scope of the invention as defined in the claims.

What is claimed is:

1. A quantum cryptography authentication system comprising:

an optical link having a first end and a second end;

a sender connected to the first end of the optical link, the sender transmitting:

a first optical pulse and a second optical pulse, the first optical pulse and the second optical pulse having a defined time delay therebetween; the first pulse modulated with a first authentication phase shift; the second pulse being modulated with phases selected from one basis of two non-orthogonal bases, and encoded with one of two orthogonal states within the one basis based on an information of the sender, the second pulse further modulated with a second authentication phase shift;

a receiver connected to the second end of the optical link, the receiver comprising:

a first polarization beam splitter receiving and splitting the first pulse into a third pulse and a fourth pulse, and the second pulse into a fifth pulse and a sixth pulse; the fourth pulse and the sixth pulse being sent to a first optical reference loop and modulated with the first authentication phase shift; the third pulse and the fifth pulse being sent to a first optical delay loop and modulated with the second authentication phase shift;

a first coupler connected to the first optical reference loop and the first optical delay loop, the first coupler combining the third pulse, the fourth pulse, the fifth pulse and the sixth pulse; the third pulse and the sixth pulse arriving at the first coupler simultaneously;

a first set of detectors receiving the combined third pulse and sixth pulse, and determining the one basis of the two non-orthogonal bases; and a second set of detectors receiving the combined third pulse and sixth pulse, and determining the one of the two orthogonal states within the basis and thereby decoding the information of the sender;

wherein the third pulse and the fifth pulse are polarized orthogonally to the fourth pulse and the sixth pulse.

2. The quantum cryptography authentication system according to claim 1, wherein the sender further comprises:

an optical source generating an optical pulse;

a second splitter connected to a second optical reference loop and a second optical delay loop, the second splitter receiving and splitting the optical pulse into the first pulse and the second pulse; the first pulse being sent to the second optical reference loop and modulated with the first authentication phase shift; the second pulse being sent to the second optical delay loop, and modulated with the information of the sender and the second authentication phase shift; and a second coupler connected to the second optical reference loop and the second optical delay loop, the second coupler collecting the first pulse and the second pulse; the second coupler connected to the first end of the optical link and transmitting the first pulse and the second pulse to the optical link.

3. The quantum cryptography authentication system according to claim 2, wherein the third pulse and the fifth pulse are horizontally polarized, and the fourth and sixth pulse are vertically polarized.

4. The quantum cryptography authentication system according to claim 2, wherein the third pulse and the fifth pulse are vertically polarized, and the fourth and sixth pulse are horizontally polarized.

5. The quantum cryptography authentication system according to claim 2, further comprising a first wave plate and a third splitter for passing the combined third pulse and sixth pulse to the first set of detectors.

6. The quantum cryptography authentication system according to claim 5, further comprising a second wave plate and a fourth splitter for passing the combined third pulse and sixth pulse to the second set of detectors.

7. The quantum cryptography authentication system according to claim 6 wherein one or more than one of the third splitter and the fourth splitter is a polarization beam splitter.

8. The quantum cryptography authentication system according to claim 1, wherein the first authentication phase shift is a device authentication phase shift, and the second authentication phase shift is a user authentication phase shift.

9. The quantum cryptography authentication system according to claim 2, wherein one or more than one of the first optical reference loop, the first optical delay loop, the second optical reference loop, and the second optical delay loop includes an optical loop characteristic adjuster.

10. The quantum cryptography authentication system according to claim 2, wherein the optical source generates weak coherent optical pulse.

11. The quantum cryptography authentication system according to claim 1, wherein characteristics of the first optical delay loop match characteristics of the second optical delay loop.

12. The quantum cryptography authentication system according to claim 1, wherein the non-orthogonal bases comprising orthogonal states in Hilbert space with equal phase differences between two neighboring phases.

13. The quantum cryptography authentication system according to claim 12, wherein the non-orthogonal bases are $(0, \pi)$ and $(\pi/2, 3\pi/2)$.

14. The quantum cryptography authentication system according to claim 6, wherein one of the first wave plate and the second wave plate is a $\lambda/2$ plate, and the other is a $\lambda/4$ plate.

15. A receiver in a quantum cryptography authentication system, the receiver comprising:

a first polarization beam splitter splitting a received first optical pulse into a third pulse, and a fourth pulse, and a received second optical pulse, into a fifth pulse and a sixth pulse, the received first optical pulse and the received second optical pulse having a defined time delay therebetween;

the second pulse being modulated with phases selected from one basis of two non-orthogonal bases, and encoded with one of two orthogonal states within the one basis based on an information of a sender; the fourth pulse and the sixth pulse being sent to an optical reference loop and modulated with a device authentication phase shift; the third pulse and the fifth pulse being sent to an optical delay loop and modulated with a user authentication phase shift;

a coupler connected to the optical reference loop and the optical delay loop, the coupler combining the third pulse, the fourth pulse, the fifth pulse and the sixth pulse; the third pulse and the sixth pulse arriving at the coupler simultaneously;

a first set of detectors receiving the combined third pulse and sixth pulse, and determining the one basis of the two non-orthogonal bases; and a second set of detectors receiving the combined third pulse and sixth pulse, and determining the one of the two orthogonal states within the basis and thereby decoding the information of the sender;

wherein the third pulse and the fifth pulse are polarized orthogonally to the fourth pulse and the sixth pulse.

16. The receiver according to claim 15, wherein the third pulse and the fifth pulse are horizontally polarized, and the fourth and sixth pulse are vertically polarized.

17. The receiver according to claim 15, further comprising a first wave plate and a second splitter for passing the combined third pulse and sixth pulse to the first set of detectors.

18. The receiver according to claim 17, further comprising a second wave plate and a third splitter for passing the combined third pulse and sixth pulse to the second set of detectors.

19. The receiver according to claim 18, wherein one or more than one of the first splitter, the second splitter and the third splitter is a polarization beam splitter.

20. A method of authenticating a sender comprising the steps of:

generating an optical pulse;

splitting the optical pulse into a first pulse and a second pulse;

transmitting the first pulse to a first optical reference loop and the second pulse to a first optical delay loop;

modulating the first pulse with a first authentication phase shift;

modulating the second pulse with phases selected from one basis of two non-orthogonal bases, and encoded with one or two orthogonal states within the one basis based on an authentication information of the sender;

modulating the second pulse with a second authentication phase shift;

collecting the first pulse and the second pulse at a first coupler connected to an optical link and transmitting the first pulse and the second pulse to a receiver;

receiving and splitting the first pulse into a third pulse and a fourth pulse, and the second pulse into a fifth pulse and a sixth pulse at the receiver;

sending the fourth pulse and the sixth pulse to a second optical reference loop;

modulating the fourth pulse and the sixth pulse with the first authentication phase shift;

sending the third pulse and the fifth pulse to a second optical delay loop;

modulating the third pulse and the fifth pulse with the second authentication phase shift;

combining the third pulse, the fourth pulse, the fifth pulse and the sixth pulse; the third pulse and the sixth pulse arriving at the second coupler simultaneously;

receiving the combined third pulse and sixth pulse at a first set of detectors;

determining the basis of one of the two non-orthogonal bases;

receiving the combined third pulse and sixth pulse at a second set of detectors; and determining the one of the two orthogonal states within the basis and thereby decoding the information of the sender;

wherein the third pulse and the fifth pulse are polarized orthogonally to the fourth pulse and the sixth pulse.

* * * * *